US011063360B2

(12) United States Patent
Hashiguchi

(10) Patent No.: US 11,063,360 B2
(45) Date of Patent: Jul. 13, 2021

(54) ANTENNA

(71) Applicant: JAPAN AVIATION ELECTRONICS INDUSTRY, LIMITED, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/784,503

(22) Filed: Feb. 7, 2020

(65) Prior Publication Data

US 2020/0335868 A1 Oct. 22, 2020

(30) Foreign Application Priority Data

Apr. 17, 2019 (JP) ..... JP2019-078217

(51) Int. Cl.
*H01Q 7/00* (2006.01)

(52) U.S. Cl.
CPC ..... *H01Q 7/005* (2013.01)

(58) Field of Classification Search
CPC ..... H01Q 7/005; H01Q 1/243; H01Q 7/00; H01Q 9/04; H01Q 1/36; H01Q 1/50; H01Q 1/38; H01Q 9/0414
USPC ..... 343/868
See application file for complete search history.

(56) References Cited

U.S. PATENT DOCUMENTS 5,350,189 A * 9/1994 Tsuchitani ..... G01P 1/003 180/282
7,113,143 B2 9/2006 Minemura
9,087,929 B2 * 7/2015 Konaka ..... H01L 23/642
9,502,761 B2 11/2016 Itoh et al.
9,692,151 B2 * 6/2017 Kunieda ..... H01R 24/46
10,211,541 B2 2/2019 Sano et al.
10,795,208 B2 * 10/2020 Suwa ..... G02F 1/134309
10,862,541 B2 * 12/2020 Kato ..... G06K 19/077
2006/0001575 A1 1/2006 Jo et al.
(Continued)

FOREIGN PATENT DOCUMENTS

JP 2005-203854 A 7/2005
JP 2016-225956 A 12/2016
(Continued)

OTHER PUBLICATIONS

Extended European Search Report in EP 20159316.7-1205 dated Sep. 16, 2020.
(Continued)

*Primary Examiner* — Jean B Jeanglaude
(74) *Attorney, Agent, or Firm* — Collard & Roe, P.C.

(57) ABSTRACT

A facing portion of an antenna is provided with a first capacitance complementary adjusting portion which adjusts variation of a capacitance caused by a first movement of a second facing portion relative to a first facing portion and a second capacitance complementary adjusting portion which adjust variation of the capacitance caused by a second movement of the second facing portion relative to the first facing portion. The first capacitance complementary adjusting portion has a first variable portion and a second variable portion which have mutually opposite effects on the capacitance. The second capacitance complementary adjusting portion has a third variable portion and a fourth variable portion which have mutually opposite effects on the capacitance.

6 Claims, 11 Drawing Sheets

(56) References Cited

U.S. PATENT DOCUMENTS

| | | | | |
|---|---|---|---|---|
| 2014/0203987 | A1 | 7/2014 | Itoh et al. | |
| 2014/0217552 | A1* | 8/2014 | Konaka | H01L 28/60 257/595 |
| 2014/0315427 | A1* | 10/2014 | Kunieda | H01R 13/7033 439/578 |
| 2016/0294048 | A1 | 10/2016 | Xu et al. | |
| 2017/0114798 | A1* | 4/2017 | Spangler | F01D 5/186 |
| 2017/0117612 | A1 | 4/2017 | Toyao et al. | |
| 2018/0117483 | A1* | 5/2018 | Weisman | A63H 23/10 |
| 2018/0351231 | A1 | 12/2018 | Sarkis et al. | |

FOREIGN PATENT DOCUMENTS

| | | | |
|---|---|---|---|
| JP | 2018-174585 | A | 11/2018 |
| JP | 2018-537037 | A | 12/2018 |

OTHER PUBLICATIONS

European Office Action dated Mar. 11, 2021 in European Application No. 20 159 316.7.

* cited by examiner

ANTENNA

CROSS REFERENCE TO RELATED APPLICATIONS

This application is based on and claims priority under 35 U.S.C. § 119 to Japanese Patent Application No. JP2019-078217 filed Apr. 17, 2019, the contents of which are incorporated herein in their entireties by reference.

BACKGROUND OF THE INVENTION

This invention relates to an antenna and, in particular, to an antenna having a split-ring resonator structure.

JP2018-174585A (Patent Document 1) discloses an antenna having a split-ring resonator structure.

As shown in FIG. 16, an antenna 90 of Patent Document 1 is provided with a capacitor consisting of two flat plate surfaces (a first facing portion and a second facing portion) 92 and 94 which are separated by an interdigital slot. Each of the flat plate surfaces 92 and 94 has an interdigital finger 921 or 941. The interdigital fingers 921 and 941 have a plurality of fingers (comb teeth) arranged in parallel with one another. Each of the fingers has a rectangular shape.

SUMMARY OF THE INVENTION

In the antenna 90 of Patent Document 1, it is possible that the two flat plate surfaces 92 and 94 are relatively moved in a horizontal plane when one or both of them receive an external force. A relative movement between the two flat plate surfaces 92 and 94 in the horizontal plane varies a capacitance of the capacitor formed by the flat plate surfaces 92 and 94 and thereby varies characteristics of the antenna 90. Thus, the antenna 90 of Patent Document 1 has a problem that the characteristics thereof are varied according to amount of the relative movement between the flat plate surfaces (the first facing portion and the second facing portion) 92 and 94 when the relative movement is caused.

It is therefore an object of the present invention to provide an antenna which has a first facing portion and a second facing portion to form a capacitor and which can suppress variations of characteristics thereof caused by a relative movement between the first facing portion and the second facing portion.

One aspect of the present invention provides an antenna comprising a main portion, a facing portion, a first feeding terminal and a second feeding terminal. The main portion has a ring-shape with a split and has a first end portion and a second end portion which form the split. The facing portion has a first facing portion provided to the first end portion and a second facing portion provided to the second end portion. The first facing portion and the second facing portion are apart from each other and face each other in a horizontal plane defined by a first horizontal direction and a second horizontal direction perpendicular to the first horizontal direction. The first facing portion and the second facing portion have a capacitance. The first feeding terminal and the second feeding terminal are provided to the main portion. The facing portion is provided with a first capacitance complementary adjusting portion and a second capacitance complementary adjusting portion. The first capacitance complementary adjusting portion adjusts a first variation of the capacitance caused by a first movement of the second facing portion relative to the first facing portion in the first horizontal direction. The second capacitance complementary adjusting portion adjusts a second variation of the capacitance caused by a second movement of the second facing portion relative to the first facing portion in the second horizontal direction. The first capacitance complementary adjusting portion has a first variable portion and a second variable portion which have mutually opposite effects on the capacitance according to the first movement. The second capacitance complementary adjusting portion has a third variable portion and a fourth variable portion which have mutually opposite effects on the capacitance according to the second movement.

In the antenna of the aforementioned aspect of the present invention, the first variable portion of the first capacitance complementary adjusting portion and the second variable portion of the first capacitance complementary adjusting portion have mutually opposite effects on the first variation of the capacitance caused by the first movement of the second facing portion relative to the first facing portion in the first horizontal direction. On the other hand, the third variable portion of the second capacitance complementary adjusting portion and the fourth variable portion of the second capacitance complementary adjusting portion have mutually opposite effects on the second variation of the capacitance caused by the second movement of the second facing portion relative to the first facing portion in the second horizontal direction. In this manner, the variations of the capacitance caused by the relative movements of the second facing portion to the first facing portion are suppressed, and variations of characteristics of the antenna are suppressed.

Although the present invention is originated from suppressing variations of characteristics of a finished antenna caused by a relative movement of facing portions of the finished antenna, a concept of the present invention is applicable to suppressing variations of characteristics of an antenna caused by variations in manufacturing processes for the antenna. Specifically, the present invention can also suppress variations of characteristics of an antenna caused by variations in manufacturing processes for the antenna to be printed and formed on a substrate.

An appreciation of the objectives of the present invention and a more complete understanding of its structure may be had by studying the following description of the preferred embodiment and by referring to the accompanying drawings.

Figure 1:
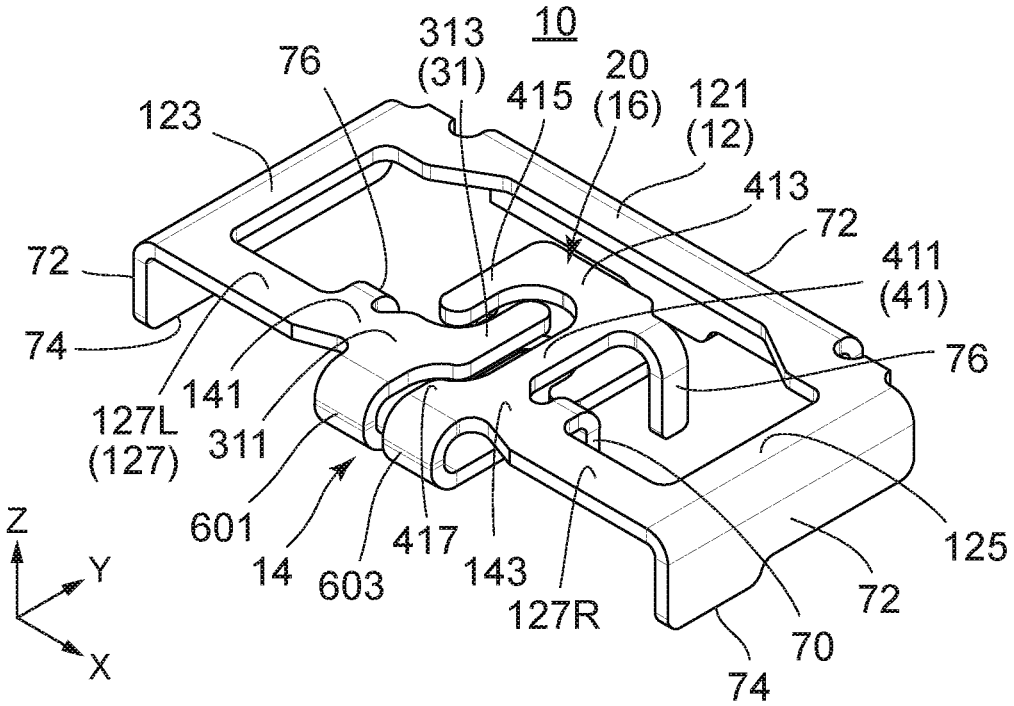
FIG. 1 is a top, perspective view showing an antenna according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
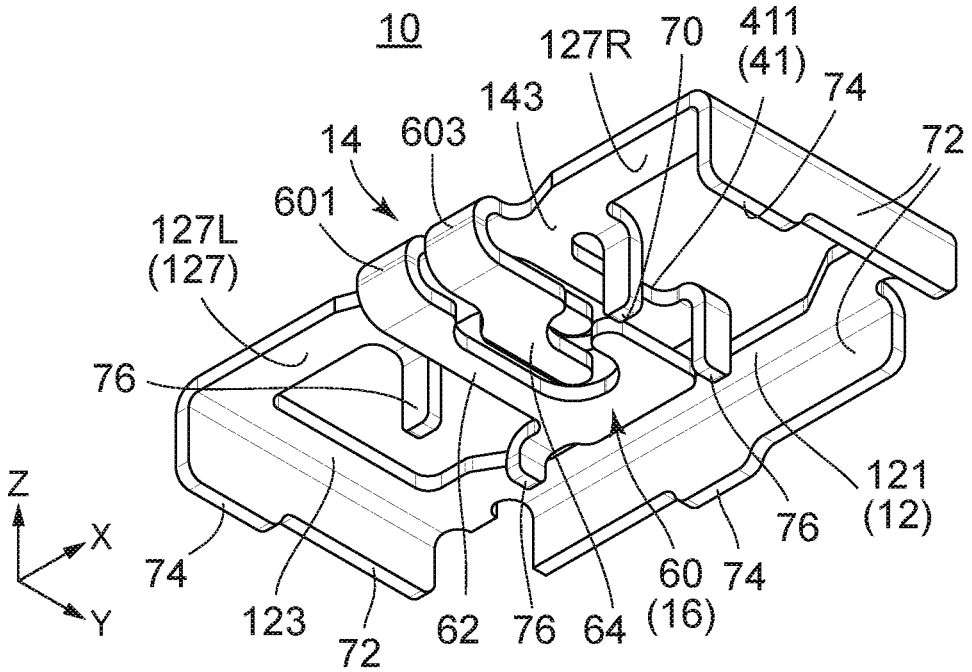
FIG. 2 is a bottom, perspective view showing the antenna of FIG. 1.

Referring to FIGS. 1 and 2, an antenna 10 according to a first embodiment of the present invention has a split-ring resonator structure. In other words, the antenna 10 of the present embodiment is a resonance antenna. In detail, the antenna 10 is provided with a main portion 12, a facing portion 16, a first feeding terminal 70, a plurality of second feeding terminals 72, a plurality of fixed portions 74 and a plurality of additional terminals 76. However, the present invention is not limited thereto. One of the second feeding terminals 72 is required at minimum. Similarly, one of the fixed portions 74 is required at minimum. In addition, the additional terminals 76 are not essential.

As understood from FIGS. 1 and 2, the antenna 10 is a discrete part to be mounted on an object (not shown) such as a circuit board. Moreover, in the present embodiment, the antenna 10 is a single-piece member formed by punching a single metal plate and bending a punched metal plate.

Figure 3:
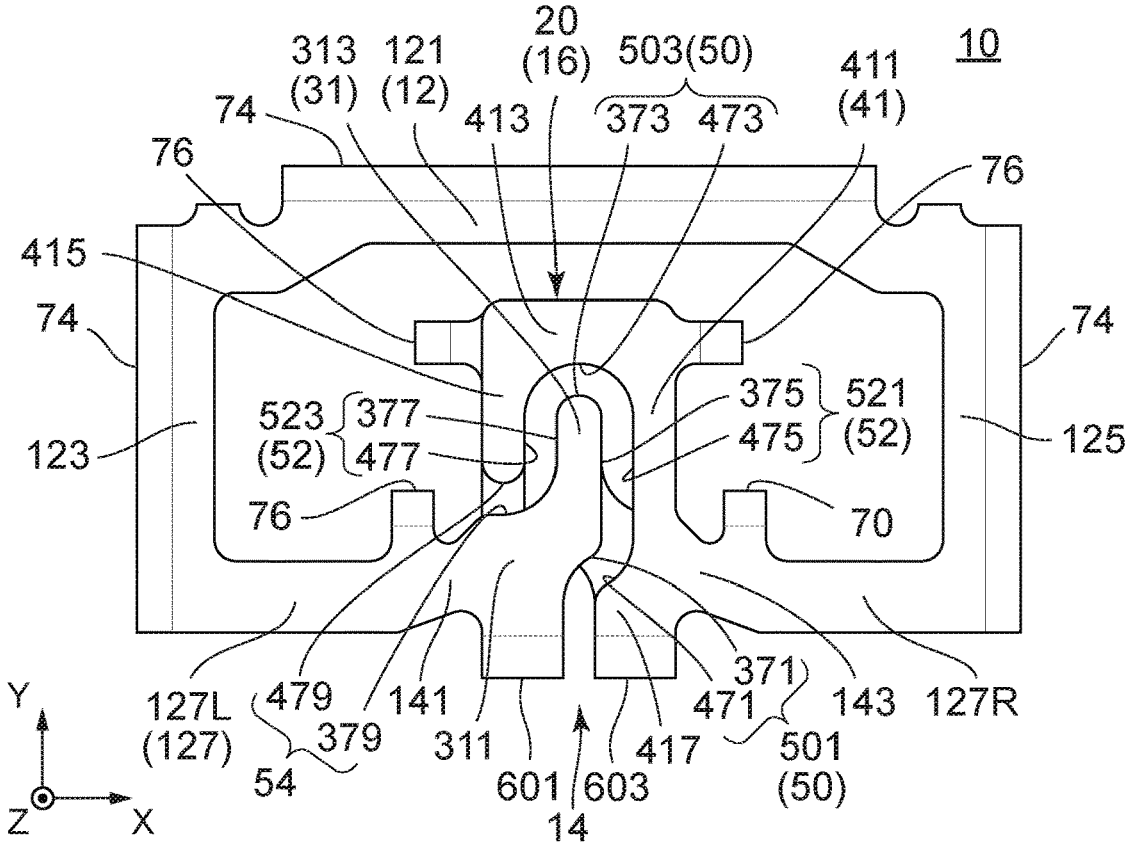
FIG. 3 is a plan view showing the antenna of FIG. 1.

As shown in FIG. 3, the main portion 12 has a ring-shape with a split 14. Here, the "ring-shape" includes a shape other than an annular-ring-shape, e.g. an elliptic-ring-shape or a polygonal-ring-shape. In the present embodiment, the main portion 12 has an approximately rectangular shape with four sides. In addition, the main portion 12 has a first end portion 141 and a second end portion 143 which form the split 14. In detail, the main portion 12 is provided with a first side portion 121 extending in a lateral direction, a second side portion 123 and a third side portion 125 which extend forward from both ends of the first side portion 121 and a fourth side portion 127 located between a front end portion of the second side portion 123 and a front end portion of the third side portion 125. In the present embodiment, the lateral direction is an X-direction. Moreover, a front-rear direction is a Y-direction perpendicular to the lateral direction. A negative Y-direction is directed forward while a positive Y-direction is directed rearward.

As shown in FIG. 3, the split 14 is formed at the middle of the fourth side portion 127 in the lateral direction. In other words, the fourth side portion 127 is divided into a fourth side left portion 127L and a fourth side right portion 127R by the split 14. The first end portion 141 of the main portion 12 is one of end portions of the fourth side left portion 127L, and the second end portion 143 of the main portion 12 is one of end portions of the fourth side right portion 127R.

As understood from FIGS. 1 and 2, the first feeding terminal 70 and the second feeding terminals 72 are provided to the main portion 12. The first feeding terminal 70 is provided to the fourth side right portion 127R and extends downward. The second feeding terminals 72 are provided to the first side portion 121, the second side portion 123 and the third side portion 125, respectively, and extend downward. The fixed portions 74 correspond to the second feeding terminals 72, respectively, and extend downward. One of the additional terminals 76 is provided to the fourth side left portion 127L and extends downward. The remains of the additional terminals 76 are provided to the facing portion 16 and extend downward. A lower end of the first feeding terminal 70, lower ends of the fixed portions 74 and lower ends of the additional terminals 76 form lower ends of the antenna 10. The first feeding terminal 70, the fixed portions 74 and the additional terminals 76 are fixed to the object (not shown) by soldering or another bonding method when the antenna 10 is mounted on the object. Moreover, the first feeding terminal 70 and the fixed portions 74 are electrically connected to connection pads, respectively, which are provided to the object.

As shown in FIG. 3, the facing portion 16 is generally located between the first side portion 121 of the main portion 12 and the fourth side portion 127 of the main portion 12 in the front-rear direction. The facing portion 16 is partly located between the first end portion 141 of the main portion 12 and the second end portion 143 of the main portion 12. Moreover, the facing portion 16 is located between the second side portion 123 of the main portion 12 and the third side portion 125 of the main portion 12 in the lateral direction. The facing portion 16 is provided on a specific one of the sides of the main portion 12. In more detail, the facing portion 16 is provided to a middle portion of the fourth side portion 127 of the main portion 12. That is, in the present embodiment, the specific one of the sides is the fourth side portion 127. However, the present invention is not limited thereto. The facing portion 16 may be provided to the fourth side portion 127 so that a distance from the facing portion 16 to one of the second side portion 123 and the third side portion 125 is shorter than a distance from the facing portion 16 to the other of the second side portion 123 and the third side portion 125. In that case, a position of the split 14 of the main portion 12 should be nearer to one of the second side portion 123 and the third side portion 125.

As understood from FIGS. 1 and 2, the facing portion 16 is provided with an upper facing portion 20 and a lower facing portion 60. As shown in FIG. 1, the upper facing portion 20 consists of a first facing portion 31 and a second facing portion 41. In detail, the upper facing portion 20 is located on a first horizontal plane defined by a first horizontal direction and a second horizontal direction perpendicular to the first horizontal direction. In other words, the first facing portion 31 and the second facing portion 41 are located on the first horizontal plane. In the present embodiment, the first horizontal direction is the Y-direction which coincides with the front-rear direction, and the second horizontal direction is the X-direction which coincides with the lateral direction. However, the present invention is not limited thereto. The first horizontal direction and the second horizontal direction may be inclined from the Y-direction and the X-direction, respectively. Additionally, in the present embodiment, the "horizontal" does not necessarily mean crossing the gravity direction at right angles.

As shown in FIG. 2, the lower facing portion 60 consists of a third facing portion 62 and a fourth facing portion 64. The lower facing portion 60 is located on a second horizontal plane defined by the first horizontal direction and the second horizontal direction. In other words, the third facing portion 62 and the fourth facing portion 64 are located on the second horizontal plane. The second horizontal plane is located downward of the first horizontal plane in an up-down direction. In other words, the lower facing portion 60 is located downward of the upper facing portion 20 in the up-down direction. In the present embodiment, the up-down direction is a Z-direction perpendicular to both of the lateral direction and the front-rear direction. A positive Z-direction is directed upward while a negative Z-direction is directed downward.

As understood from FIGS. 1 and 3, the first facing portion 31 and the second facing portion 41 are provided to the first end portion 141 of the main portion 12 and the second end portion 143 of the main portion 12, respectively. In other words, the upper facing portion 20 has the first facing portion 31 provided to the first end portion 141 and the second facing portion 41 provided to the second end portion 143. The first facing portion 31 and the second facing portion 41 are apart from the first side portion 121 of the main portion 12, the second side portion 123 of the main portion 12 and the third side portion 125 of the main portion 12.

As understood from FIGS. 1 and 2, the third facing portion 62 and the fourth facing portion 64 are provided to the first end portion 141 of the main portion 12 and the second end portion 143 of the main portion 12, respectively, through connection portions 601 and 603. The lower facing portion 60 is formed and arranged so that the lower facing portion 60 and the upper facing portion 20 are rotationally symmetric with respect to a symmetrical axis (not shown) extending in the front-rear direction. Accordingly, the following description made about the first facing portion 31 and the second facing portion 41 holds true for the third facing portion 62 and the fourth facing portion 64 with the necessary changes.

As shown in FIG. 3, the first facing portion 31 and the second facing portion 41 are apart from each other and face each other in the first horizontal plane. With this structure, the first facing portion 31 and the second facing portion 41 form a capacitor and have a capacitance. In other words, the upper facing portion 20 has the capacitance which is a part of a capacitance of the facing portion 16. On the other hand, the main portion 12 forms an inductor. The main portion 12 and the facing portion 16 form an LC resonator circuit.

As shown in FIG. 3, one of the first facing portion 31 and the second facing portion 41 has a first primary line 311 extending from the first end portion 141 at least in a positive X-direction and a second primary line 313 extending rearward from an end of the first primary line 311. In detail, the first primary line 311 extends in the positive Y-direction as well as the positive X-direction. The remaining one of the first facing portion 31 and the second facing portion 41 has a third primary line 411 extending rearward from the second end portion 143, a fourth primary line 413 extending from a rear end of the third primary line 411 in a negative X-direction, a fifth primary line 415 extending forward from an end of the fourth primary line 413 and a facing secondary line 417 extending from the second end portion 143 in the negative X-direction. In the present embodiment, the one of the first facing portion 31 and the second facing portion 41 is the first facing portion 31 while the remaining one of them is the second facing portion 41. However, the present invention is not limited thereto. The first facing portion 31 and the second facing portion 41 may be interchanged.

As shown in FIG. 3, the first facing portion 31 has a first part 371, a second part 373, a third part 375 and a fourth part 377. The first part 371 is a side surface of the first primary line 311. The second part 373 is an end surface of the second primary line 313. The third part 375 is a side surface of the second primary line 313. The fourth part 377 is another side surface of the second primary line 313. The first part 371 is directed at least in a first orientation. The second part 373 is directed at least in a second orientation. The third part 375 is directed at least in a third orientation. The fourth part 377 is directed at least in a fourth orientation. Here, the first orientation and the second orientation are directed in mutually opposite directions and given by the first horizontal direction. In other words, the first orientation and the second orientation are parallel to the first horizontal direction and directed in the mutually opposite directions. In the present embodiment, the first orientation is directed in the negative Y-direction while the second orientation is directed in the positive Y-direction. The third orientation and the fourth orientation are directed in mutually opposite directions and given by the second horizontal direction. In other words, the third orientation and the fourth orientation are parallel to the second horizontal direction and directed in the mutually opposite directions. In the present embodiment, the third orientation is directed in the positive X-direction while the fourth orientation is directed in the negative X-direction. From the above, the first part 371 is directed in the third orientation as well as the first orientation. The second part 373 has a part directed in the third orientation as well as the second orientation and another part directed in the fourth orientation as well as the second orientation. The third part 375 is directed in the third orientation. The fourth part 377 is directed in the fourth orientation.

As shown in FIG. 3, the second facing portion 41 has a first facing part 471, a second facing part 473, a third facing part 475 and a fourth facing part 477. The first facing part 471 is a side surface of the facing secondary line 417. The second facing part 473 is a side surface of the fourth primary line 413. The third facing part 475 is a side surface of the third primary line 411. The fourth facing part 477 is a side surface of the fifth primary line 415. The first facing part 471 is directed at least in the second orientation. The second facing part 473 is directed at least in the first orientation. The third facing part 475 is directed at least in the fourth orientation. The fourth facing part 477 is directed at least in the third orientation. In the present embodiment, the first facing part 471 is directed in the fourth orientation as well as the second orientation. The second facing part 473 has a part directed in the third orientation as well as the first orientation and another part directed in the fourth orientation as well as the first orientation. The third facing part 475 is directed in the fourth orientation. The fourth facing part 477 is directed in the third orientation.

As understood from FIG. 3, the first part 371 and the first facing part 471 face each other to form a first variable portion 501. The second part 373 and the second facing part 473 face each other to form a second variable portion 503. The third part 375 and the third facing part 475 face each other to form a third variable portion 521. The fourth part 377 and the fourth facing part 477 face each other to form a fourth variable portion 523.

As understood from FIG. 3, the first variable portion 501 and the second variable portion 503 mainly have first and second effects on the capacitance of the upper facing portion 20, respectively, according to a first movement which is a movement of the second facing portion 41 relative to the first facing portion 31 in the first horizontal direction. The first effect of the first variable portion 501 given by the first movement on the capacitance and the second effect of the second variable portion 503 given by the first movement on the capacitance are mutually opposite effects. In other words, the first variable portion 501 and the second variable portion 503 have complementary effects on the capacitance according to the first movement. When the first part 371 is brought close to the first facing part 471 in the first horizontal direction, the second part 373 is brought away from the second facing part 473 in the first horizontal direction, for example. At that time, the first variable portion 501 increases the capacitance while the second variable portion 503 decreases the capacitance. In this manner, the first variable portion 501 and the second variable portion 503 serve as a first capacitance complementary adjusting portion 50 which adjusts a first variation of the capacitance caused by the first movement of the second facing portion 41 relative to the first facing portion 31 in the first horizontal direction. In other words, the upper facing portion 20 is provided with the first capacitance complementary adjusting portion 50 which adjusts the first variation of the capacitance of the capacitor caused by the first movement of the second facing portion 41 relative to the first facing portion 31 in the first horizontal direction. The first capacitance complementary adjusting portion 50 has the first variable portion 501 which has the first effect on the capacitance of the capacitor according to the first movement and the second variable portion 503 which has the second effect on the capacitance of the capacitor according to the first movement, wherein the second effect is opposite to the first effect of the first variable portion 501.

As understood from FIG. 3, the third variable portion 521 and the fourth variable portion 523 have third and fourth effects on the capacitance of the upper facing portion 20, respectively, according to a second movement which is a movement of the second facing portion 41 relative to the first facing portion 31 in the second horizontal direction. The third effect of the third variable portion 521 given by the second movement on the capacitance and the fourth effect of the fourth variable portion 523 given by the second movement on the capacitance are mutually opposite effects. In other words, the third variable portion 521 and the fourth variable portion 523 have complementary effects on the capacitance according to the second movement. When the third part 375 is brought close to the third facing part 475 in the second horizontal direction, the fourth part 377 is brought away from the fourth facing part 477 in the second horizontal direction, for example. At that time, the third variable portion 521 increases the capacitance while the fourth variable portion 523 decreases the capacitance. In this manner, the third variable portion 521 and the fourth variable portion 523 serve as a second capacitance complementary adjusting portion 52 which adjusts a second variation of the capacitance caused by the second movement of the second facing portion 41 relative to the first facing portion 31 in the second horizontal direction. In other words, the upper facing portion 20 is provided with the second capacitance complementary adjusting portion 52 which adjusts the second variation of the capacitance of the capacitor caused by the second movement of the second facing portion 41 relative to the first facing portion 31 in the second horizontal direction. The second capacitance complementary adjusting portion 52 has the third variable portion 521 which has the third effect on the capacitance of the capacitor according to the second movement and the fourth variable portion 523 which has the fourth effect on the capacitance of the capacitor according to the second movement, wherein the fourth effect is opposite to the third effect of the third variable portion 521.

Referring to FIG. 3, the first facing portion 31 further has a fifth part 379. The fifth part 379 is another side surface of the first primary line 311. Moreover, the second facing portion 41 further has a fifth facing part 479. The fifth facing part 479 is an end surface of the fifth primary line 415. The fifth part 379 is directed in the fourth orientation as well as the second orientation. The fifth facing part 479 is directed at least in the first orientation. The fifth part 379 and the fifth facing part 479 face each other to form a fifth variable portion 54. The fifth variable portion 54 acts in the same way as the second variable portion 503 upon the first movement and functions as a part of the first capacitance complementary adjusting portion 50.

As mentioned above, the antenna 10 according to the present embodiment is provided with the first capacitance complementary adjusting portion 50 and the second capacitance complementary adjusting portion 52. Therefore, a variation of the capacitance of the upper facing portion 20 is suppressed even if a movement of the second facing portion 41 relative to the first facing portion 31 is caused in one or both of the first horizontal direction and the second horizontal direction. Similarly, in the lower facing portion 60, a variation of a capacitance of the lower facing portion 60 is suppressed even if a movement of the fourth facing portion 64 relative to the third facing portion 62 is caused in one or both of the first horizontal direction and the second horizontal direction. As a result, variations of characteristics of the antenna 10 are suppressed.

Second Embodiment

Figure 4:
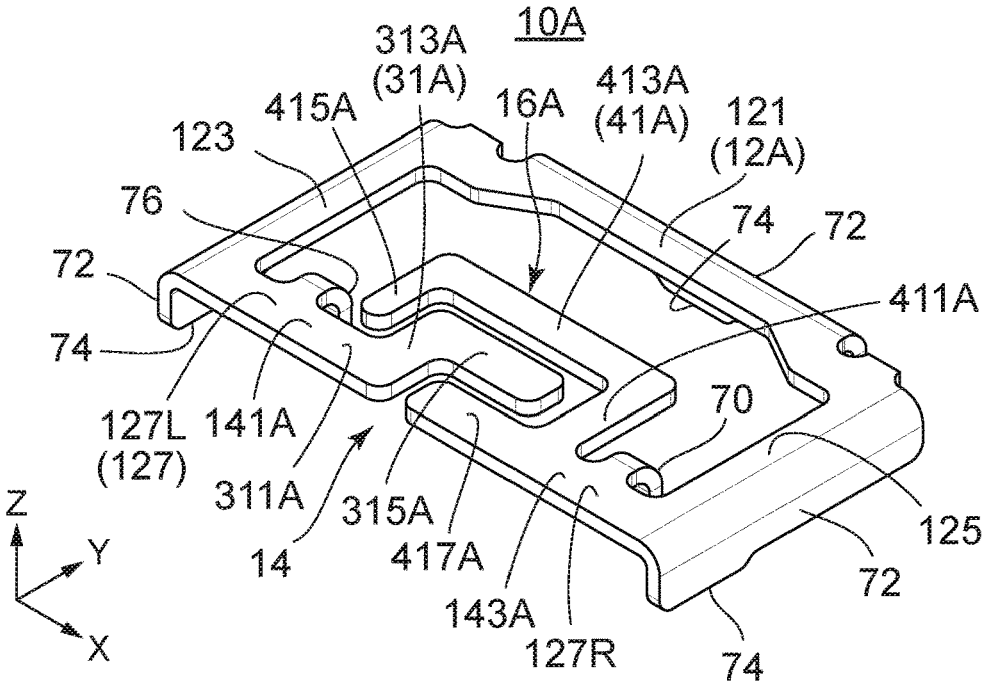
FIG. 4 is a top, perspective view showing an antenna according to a second embodiment of the present invention.
Figure 5:
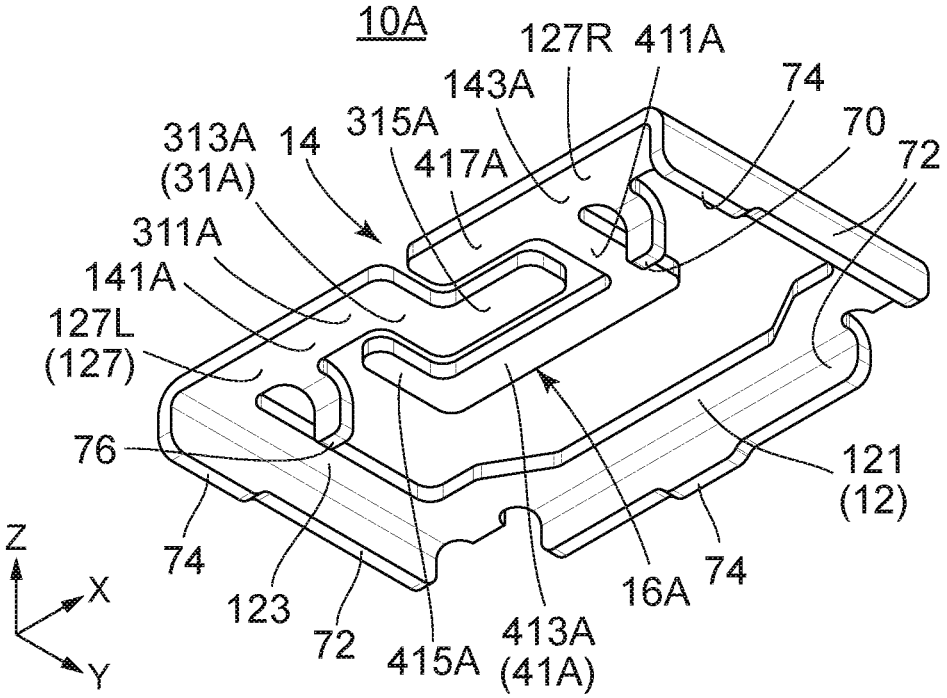
FIG. 5 is a bottom, perspective view showing the antenna of FIG. 4.

Referring to FIGS. 4 and 5, an antenna 10A according to a second embodiment of the present invention is provided with a facing portion 16A different in structure from the facing portion 16 of the antenna 10 according to the first embodiment shown in FIGS. 1 to 3.

Figure 6:
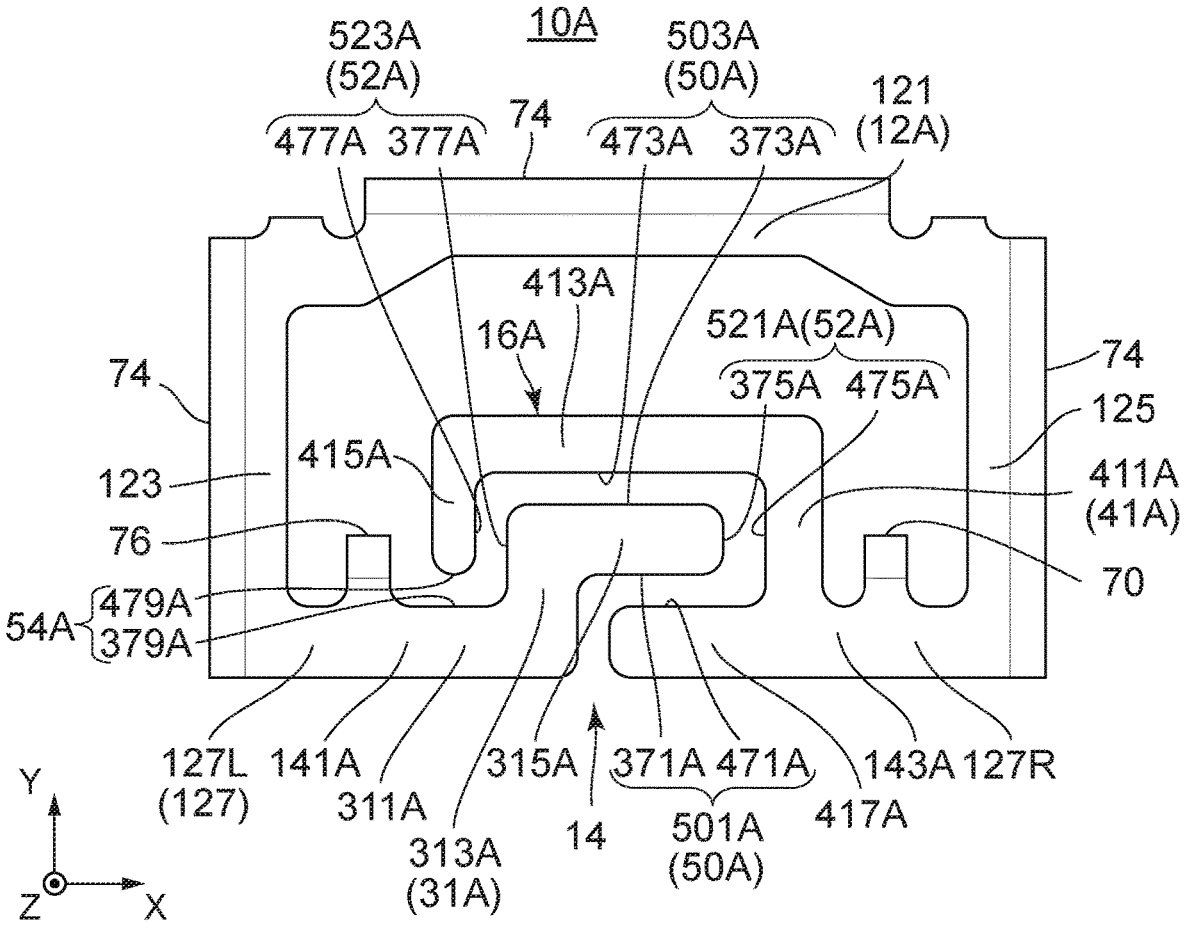
FIG. 6 is a plan view showing the antenna of FIG. 4.

As shown in FIG. 6, the facing portion 16A of the antenna 10A has a first facing portion 31A and a second facing portion 41A.

As shown in FIG. 6, the first facing portion 31A has a first primary line 311A extending in the second horizontal direction, a second primary line 313A extending from an end of the first primary line 311A in the first horizontal direction and a secondary line 315A extending from an end of the second primary line 313A in the second horizontal direction. In detail, the first primary line 311A extends from a first end portion 141A in the positive X-direction. The second primary line 313A extends rearward from the end of the first primary line 311A. The secondary line 315A extends from the end of the second primary line 313A in the positive X-direction. However, the present invention is not limited thereto. Although a length of the secondary line 315A is longer than a length of the first primary line 311A in the present embodiment, the length of the secondary line 315A may be shorter than the length of the first primary line 311A.

As shown in FIG. 6, the second facing portion 41A has a third primary line 411A extending in the first horizontal direction, a fourth primary line 413A extending from an end of the third primary line 411A in the second horizontal direction, a fifth primary line 415A extending from an end of the fourth primary line 413A in the first horizontal direction and a facing secondary line 417A extending from a second end portion 143A in the second horizontal direction. In detail, the third primary line 411A extends rearward from the second end portion 143A. The fourth primary line 413A extends rearward from the end of the third primary line 411A. The fifth primary line 415A extends forward from the end of the fourth primary line 413A. The facing secondary line 417A extends from the second end portion 143A in the negative X-direction.

As shown in FIG. 6, the second primary line 313A is located between the third primary line 411A and the fifth primary line 415A in the second horizontal direction. Moreover, an end portion of the second primary line 313A faces the fourth primary line 413A in the first horizontal direction. The secondary line 315A is located between the fourth primary line 413A and the facing secondary line 417A in the first horizontal direction. Moreover, the secondary line 315A extends toward the third primary line 411A, and an end portion of the secondary line 315A faces the third primary line 411A. The facing secondary line 417A extends toward the second primary line 313A, and an end portion of the facing secondary line 417A faces the second primary line 313A. Moreover, the facing secondary line 417A faces the secondary line 315A in the first horizontal direction.

As shown in FIG. 6, the first facing portion 31A has a first part 371A, a second part 373A, a third part 375A and a fourth part 377A. The first part 371A is a side surface of the secondary line 315A and directed in the first orientation. The second part 373A is another side surface of the secondary line 315A and directed in the second orientation. The third part 375A is an end surface of the secondary line 315A and directed in the third orientation. The fourth part 377A is a side surface of the first primary line 311A and directed in the fourth orientation.

As shown in FIG. 6, the second facing portion 41A has a first facing part 471A, a second facing part 473A, a third facing part 475A and a fourth facing part 477A. The first facing part 471A is a side surface of the facing secondary line 417A and directed in the second orientation. The second facing part 473A is a side surface of the fourth primary line 413A and directed in the first orientation. The third facing part 475A is a side surface of the third primary line 411A and directed in the fourth orientation. The fourth facing part 477A is a side surface of the fifth primary line 415A and directed in the third orientation.

As understood from FIG. 6, the first part 371A and the first facing part 471A face each other to form a first variable portion 501A. The second part 373A and the second facing part 473A face each other to form a second variable portion 503A. The third part 375A and the third facing part 475A face each other to form a third variable portion 521A. The fourth part 377A and the fourth facing part 477A face each other to form a fourth variable portion 523A.

As understood from FIG. 6, the first variable portion 501A and the second variable portion 503A have complementary effects on a capacitance of the facing portion 16A according to a first movement which is a movement of the second facing portion 41A relative to the first facing portion 31A in the first horizontal direction. In other words, the first variable portion 501A and the second variable portion 503A work as a first capacitance complementary adjusting portion 50A which adjusts a first variation of the capacitance caused by the first movement of the second facing portion 41A relative to the first facing portion 31A in the first horizontal direction.

On the other hand, as understood from FIG. 6, the third variable portion 521A and the fourth variable portion 523A have complementary effects on the capacitance of the facing portion 16A according to a second movement which is a movement of the second facing portion 41A relative to the first facing portion 31A in the second horizontal direction. In other words, the third variable portion 521A and the fourth variable portion 523A work as a second capacitance complementary adjusting portion 52A which adjusts a second variation of the capacitance caused by the second movement of the second facing portion 41A relative to the first facing portion 31A in the second horizontal direction.

Referring to FIG. 6, an end surface of the fifth primary line 415A and a side surface of the first end portion 141A face each other in the first horizontal direction to form a fifth variable portion 54A. In other words, the fifth variable portion 54A is formed by a fifth part 379A, which is the side surface of the first end portion 141A, and a fifth facing part 479A, which is the end surface of the fifth primary line 415A. The fifth variable portion 54A acts in the same way as the second variable portion 503A upon the first movement and functions as a part of the first capacitance complementary adjusting portion 50A.

As mentioned above, also in the antenna 10A according to the present embodiment, the first capacitance complementary adjusting portion 50A and the second capacitance complementary adjusting portion 52A are provided. Accordingly, a variation of the capacitance of the facing portion 16A is suppressed even if a movement of the second facing portion 41A relative to the first facing portion 31A is caused. As a result, variations of characteristics of the antenna 10A are suppressed. In addition, the antenna 10A according to the present embodiment is simple in structure and inexpensive in comparison with the antenna 10 according to the first embodiment.

Third Embodiment

Figure 7:
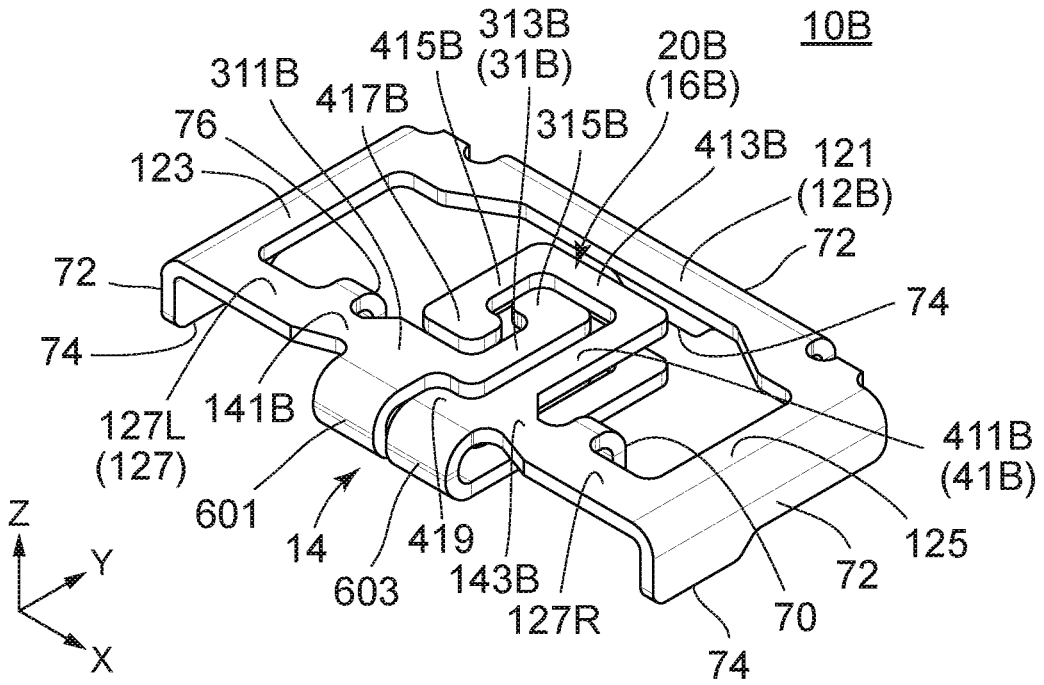
FIG. 7 is a top, perspective view showing an antenna according to a third embodiment of the present invention.
Figure 8:
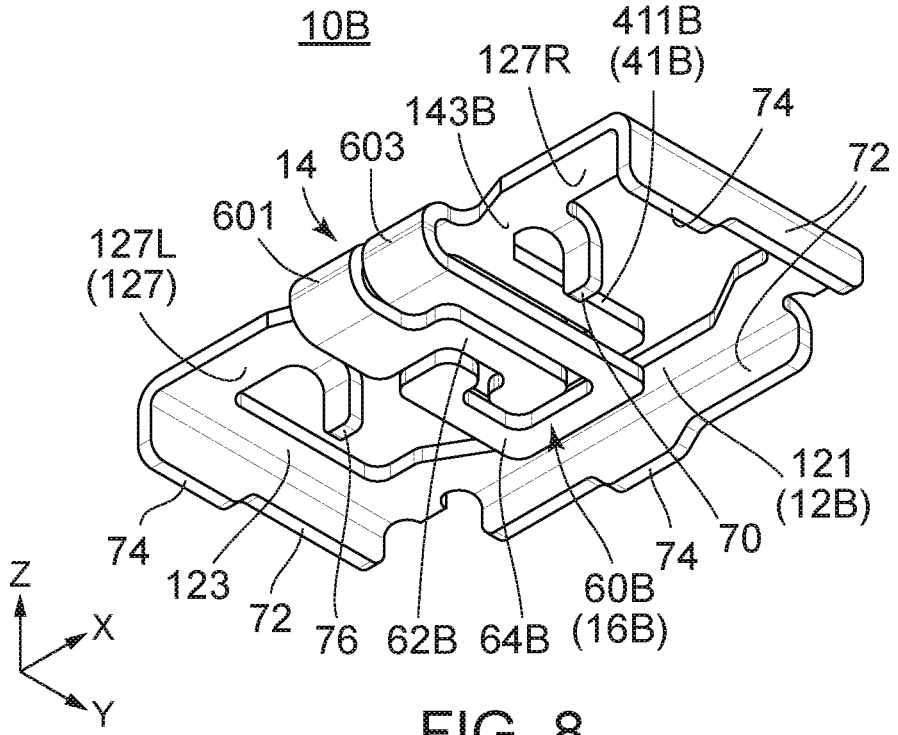
FIG. 8 is a bottom, perspective view showing the antenna of FIG. 7.

Referring to FIGS. 7 and 8, an antenna 10B according to a third embodiment of the present invention is provided with a facing portion 16B different in structure from the facing portions 16 and 16A of the antennas 10 and 10A according to the first and the second embodiments shown in FIGS. 1 to 6. In detail, the facing portion 16B has an upper facing portion 20B and a lower facing portion 60B. Moreover, the upper facing portion 20B has a first facing portion 31B and a second facing portion 41B while the lower facing portion 60B has a third facing portion 62B and a fourth facing portion 64B.

Figure 9:
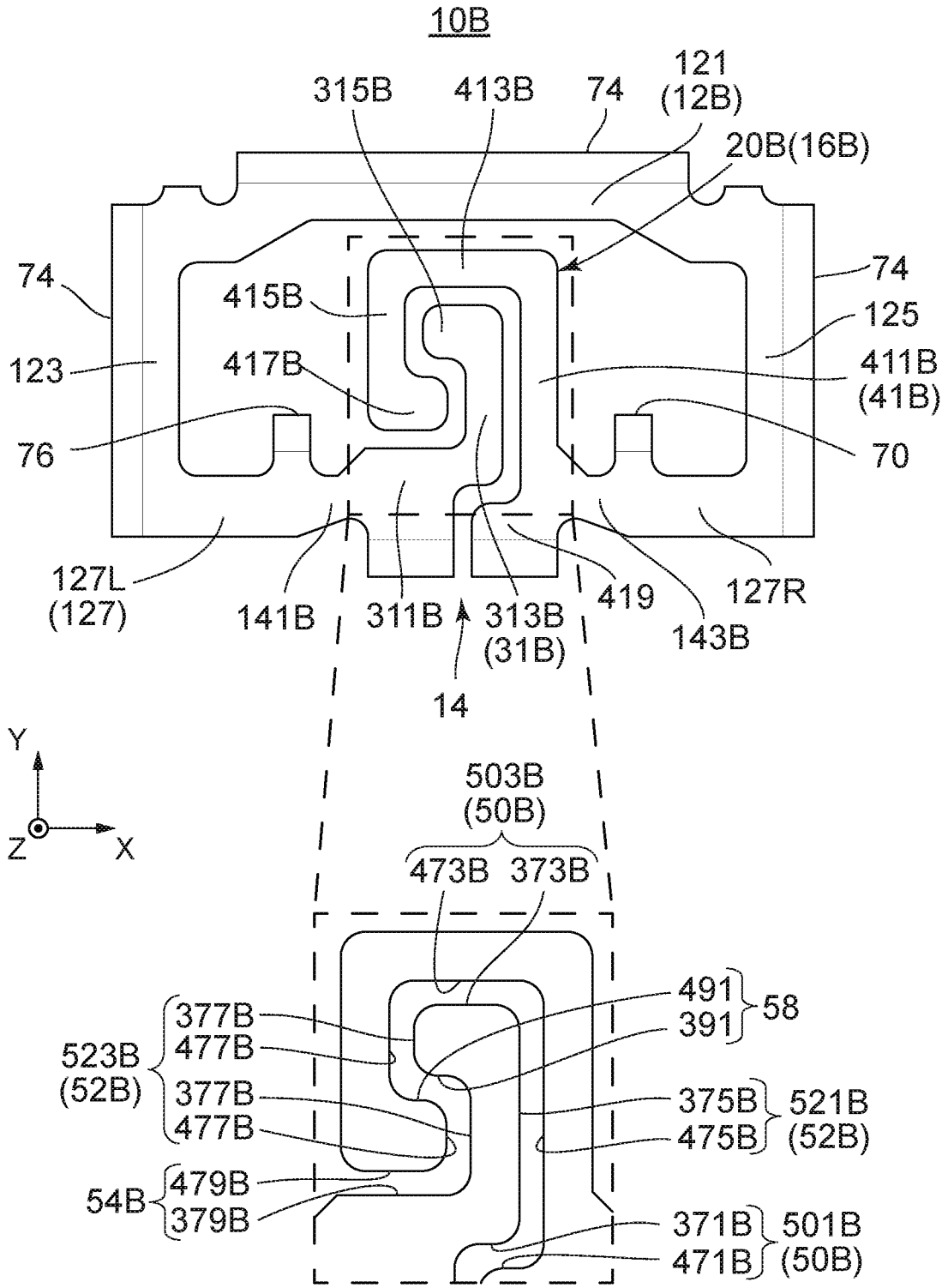
FIG. 9 is a plan view showing the antenna of FIG. 7. A facing portion is enlarged to be drawn.

As shown in FIG. 9, the upper facing portion 20B and the lower facing portion 60B are identical with each other when viewed along the up-down direction. In other words, the first facing portion 31B and the third facing portion 62B (see FIG. 8) are identical with each other in shape, and the second facing portion 41B and the fourth facing portion 64B (see FIG. 2) are identical with each other in shape. However, the present invention is not limited thereto. The upper facing portion 20B and the lower facing portion 60B may be formed so as to be rotationally symmetric like the first embodiment.

Referring to FIG. 9, the first facing portion 31B has a first primary line 311B extending in the second horizontal direction, a second primary line 313B extending from an end of the first primary line 311B in the first horizontal direction and a secondary line 315B extending from an end of the second primary line 313B in the second horizontal direction. In detail, the first primary line 311B extends from a first end portion 141B in the positive X-direction. The second primary line 313B extends rearward from the end of the first primary line 311B. The secondary line 315B extends from the end of the second primary line 313B in the negative X-direction. However, the present invention is not limited thereto. The first facing portion 31B may have another secondary line extending in the positive X-direction instead of or in addition to the secondary line 315B.

As shown in FIG. 9, the second facing portion 41B has a third primary line 411B extending in the first horizontal direction, a fourth primary line 413B extending from an end of the third primary line 411B in the second horizontal direction, a fifth primary line 415B extending from an end of the fourth primary line 413B in the first horizontal direction, a facing secondary line 417B extending from an end of the fifth primary line 415B in the second horizontal direction and an additional facing secondary line 419 extending from a second end portion 143B in the second horizontal direction. In detail, the third primary line 411B extends rearward from the second end portion 143B. The fourth primary line 413B extends from the end of the third primary line 411B in the negative X-direction. The fifth primary line 415B extends forward from the end of the fourth primary line 413B. The facing secondary line 417B extends from the end of the fifth primary line 415B in the positive X-direction. The additional facing secondary line 419 extends in the negative X-direction. However, the present invention is not limited thereto. The second facing portion 41B may have another facing secondary line extending in the negative X-direction instead of or in addition to the facing secondary line 417B depending on a shape of the first facing portion 31B.

As shown in FIG. 9, the second primary line 313B is located between the third primary line 411B and the fifth primary line 415B in the second horizontal direction. Moreover, an end portion of the second primary line 313B faces the fourth primary line 413B in the first horizontal direction. The secondary line 315B is located between the fourth primary line 413B and the facing secondary line 417B in the first horizontal direction. Moreover, the secondary line 315B extends toward the fifth primary line 415B, and an end portion of the secondary line 315B faces the fifth primary line 415B. The facing secondary line 417B extends toward the second primary line 313B, and an end portion of the facing secondary line 417B faces the second primary line 313B. Moreover, the facing secondary line 417B faces the secondary line 315B in the first horizontal direction.

As shown in FIG. 9, the first facing portion 31B has a first part 371B, a second part 373B, a third part 375B and a fourth part 377B. The first part 371B is a side surface of the first primary line 311B and directed at least in the first orientation. The second part 373B is formed by an end surface of the second primary line 313B and a side surface of the secondary line 315B and directed at least in the second orientation. The third part 375B is a side surface of the second primary line 313B and directed at least in the third orientation. The fourth part 377B is formed by two parts of an end surface of the secondary line 315B and another side surface of the second primary line 313B and directed at least in the fourth orientation. Between the two parts of the fourth part 377B, an additional first part 391 is provided. The additional first part 391 is another surface of the secondary line 315B and directed at least in the first orientation.

On the other hand, as shown in FIG. 9, the second facing portion 41B has a first facing part 471B, a second facing part 473B, a third facing part 475B and a fourth facing part 477B. The first facing part 471B is a side surface of the additional facing secondary line 419. The first facing part 471B is directed at least in the second orientation. The second facing part 473B is a side surface of the fourth primary line 413B and directed at least in the first orientation. The third facing part 475B is a side surface of the third primary line 411B and directed in the fourth orientation. The fourth facing part 477B is formed by two parts of a side surface of the fifth primary line 415B and an end surface of the facing secondary line 417B and directed at least in the third orientation. Between the two parts of the fourth facing part 477B, an additional first facing part 491 is provided. The additional first facing part 491 is a side surface of the facing secondary line 417B and directed at least in the second orientation.

As understood from FIG. 9, the first part 371B and the first facing part 471B face each other to form a first variable portion 501B. The second part 373B and the second facing part 473B face each other to form a second variable portion 503B. The third part 375B and the third facing part 475B face each other to form a third variable portion 521B. The fourth part 377B and the fourth facing part 477B face each other to form a fourth variable portion 523B. The additional first part 391 and the additional first facing part 491 face each other to form an additional first variable portion 58.

As understood from FIG. 9, the first variable portion 501B and the second variable portion 503B have complementary effects on a capacitance of the upper facing portion 20B according to a first movement which is a movement of the second facing portion 41B relative to the first facing portion 31B in the first horizontal direction. In other words, the first variable portion 501B and the second variable portion 503B work as a first capacitance complementary adjusting portion 50B which adjusts a first variation of the capacitance caused by the first movement of the second facing portion 41B relative to the first facing portion 31B in the first horizontal direction. The additional first variable portion 58 acts in the same way as the first variable portion 501B and functions as a part of the first capacitance complementary adjusting portion 50B.

On the other hand, as understood from FIG. 9, the third variable portion 521B and the fourth variable portion 523B have complementary effects on the capacitance of the upper facing portion 20B according to a second movement which is a movement) of the second facing portion 41B relative to the first facing portion 31B in the second horizontal direction. In other words, the third variable portion 521B and the fourth variable portion 523B work as a second capacitance complementary adjusting portion 52B which adjusts a second variation of the capacitance caused by the second movement of the second facing portion 41B relative to the first facing portion 31B in the second horizontal direction.

As shown in FIG. 9, an end surface of the fifth primary line 415B and another side surface of the first primary line 311B face each other in the first horizontal direction to form a fifth variable portion 54B. In other words, the fifth variable portion 54B is formed by a fifth part 379B, which is the other side surface of the first primary line 311B, and a fifth facing part 479B, which is the end surface of the fifth primary line 415B. The fifth variable portion 54B acts in the same way as the second variable portion 503B upon the first movement and functions as a part of the first capacitance complementary adjusting portion 50B.

As mentioned above, also in the antenna 10B according to the present embodiment, the first capacitance complementary adjusting portion 50B and the second capacitance complementary adjusting portion 52B are provided. Accordingly, a variation of the capacitance of the upper facing portion 20B is suppressed even if a movement of the second facing portion 41B relative to the first facing portion 31B is caused. In addition, since the antenna 10B according to the present embodiment is provided with the secondary line 315B and the facing secondary line 417B, it can reduce a difference between an effect on the capacitance according to a movement of the second facing portion 41B relative to the first facing portion 31B in the first orientation and an effect on the capacitance according to a movement of the second facing portion 41B relative to the first facing portion 31B in the second orientation. In this manner, the variations of the capacitance of the upper facing portion 20B can be further suppressed. Also in the lower facing portion 60B, similarly to the upper facing portion 20B, a variation of a capacitance of the lower facing portion 60 is suppressed even if a movement of the fourth facing portion 64B relative to the third facing portion 62B in the first horizontal direction and the second horizontal direction.

Fourth Embodiment

Figure 10:
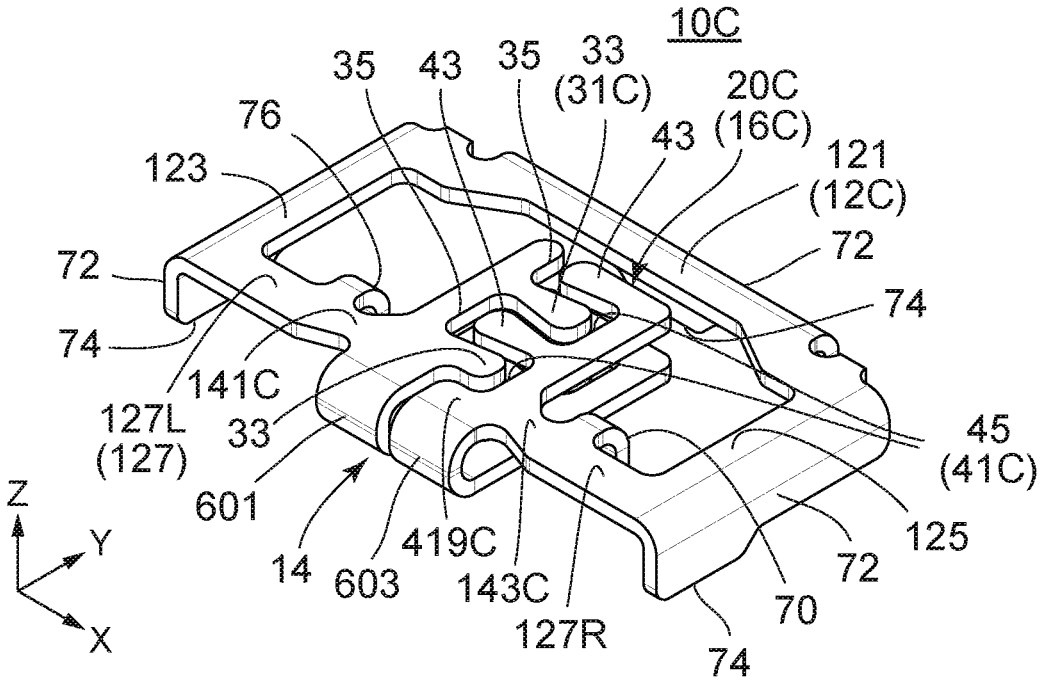
FIG. 10 is a top, perspective view showing an antenna according to a fourth embodiment of the present invention.
Figure 11:
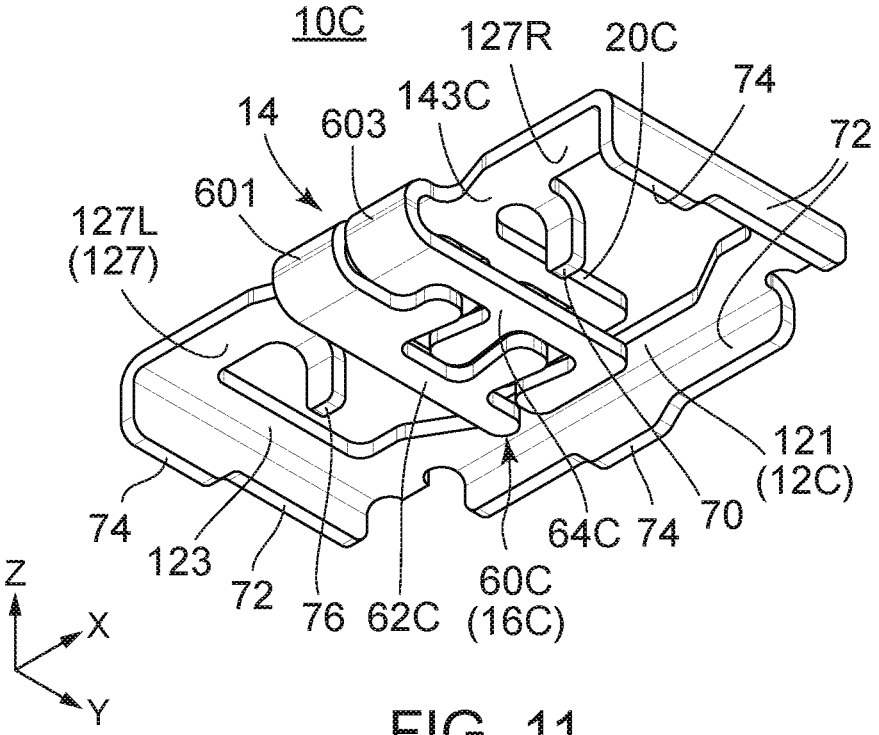
FIG. 11 is a bottom, perspective view showing the antenna of FIG. 10.

Referring to FIGS. 10 and 11, an antenna 10C according to a fourth embodiment of the present embodiment is provided with a facing portion 16C different from the facing portions 16, 16A and 16B of the antennas 10, 10A and 10B according to the first to the third embodiments shown in FIGS. 1 to 9. In detail, the facing portion 16C has an upper facing portion 20C and a lower facing portion 60C. Moreover, the upper facing portion 20C has a first facing portion 31C and a second facing portion 41C while the lower facing portion 60C has a third facing portion 62C and a fourth facing portion 64C.

Figure 12:
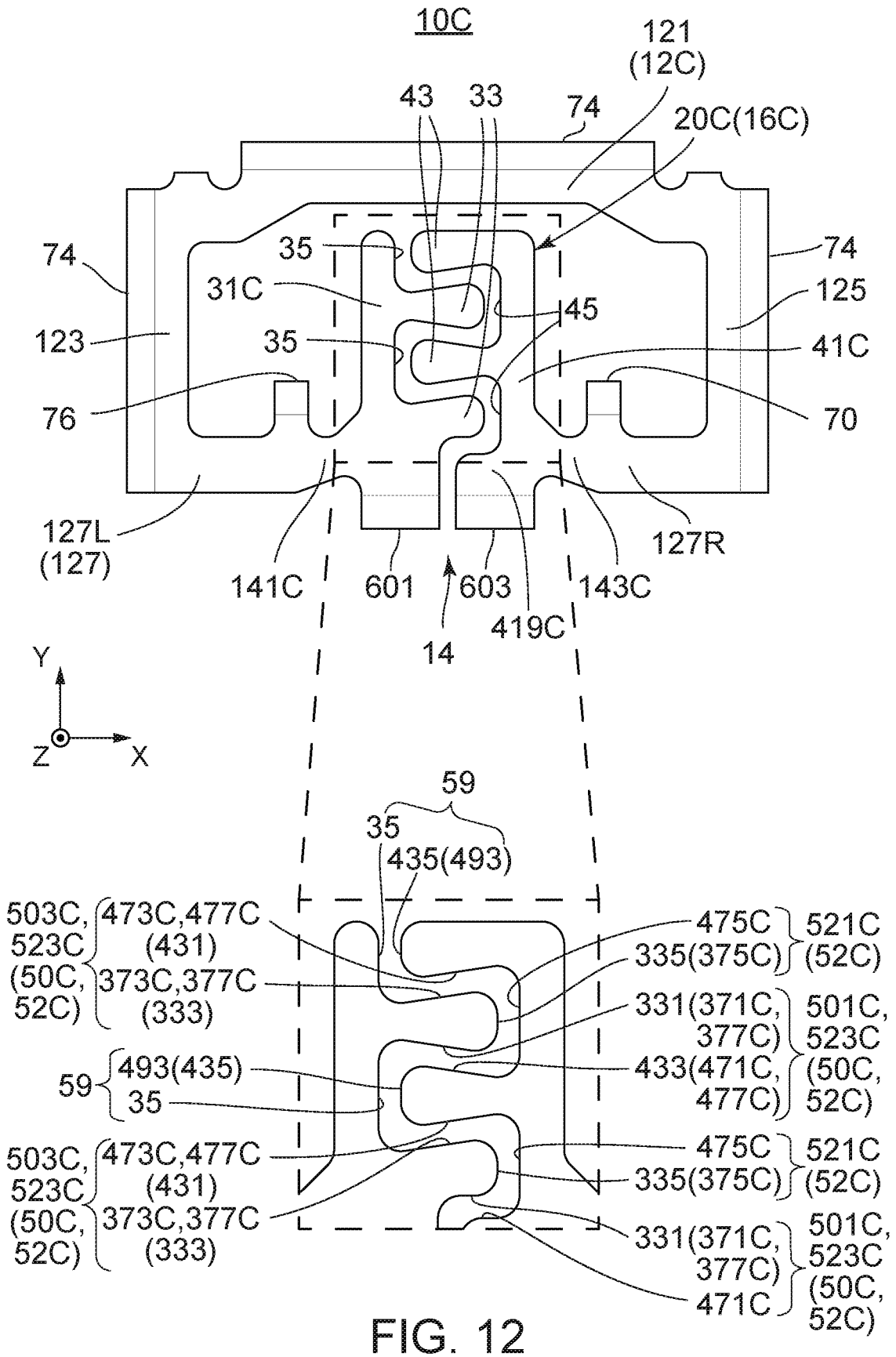
FIG. 12 is a plan view showing the antenna of FIG. 10. A facing portion is enlarged to be drawn.

As understood from FIG. 12, the upper facing portion 20C and the lower facing portion 60C (see FIG. 11) are identical with each other when viewed along the up-down direction. In other words, the first facing portion 31C and the third facing portion 62C (see FIG. 11) are identical with each other in shape while the second facing portion 41C and the fourth facing portion 64C (see FIG. 11) are identical with each other in shape. However, the present invention is not limited thereto. The upper facing portion 20C and the lower facing portion 60C may be formed so as to be rotationally symmetrical like the first embodiment.

As shown in FIG. 12, each of the first facing portion 31C and the second facing portion 41C has a comb teeth shape. In detail, the first facing portion 31C has a plurality of comb teeth 33 and a plurality of fork portions 35, and the second facing portion 41C has a plurality of comb teeth 43 and a plurality of fork portions 45. In the present embodiment, each of the number of the comb teeth 33, the number of the fork portions 35, the number of the comb teeth 43 and the number of the fork portions 45 is two. The second facing portion 41C further has an additional facing secondary line 419C. In the first facing portion 31C, the comb teeth 33 and the fork portions 35 are alternately arranged in the first horizontal direction. Similarly, in the second facing portion 41C, the comb teeth 43 and the fork portions 45 are alternately arranged in the first horizontal direction. The comb teeth 33 of the first facing portion 31C and the comb teeth 43 of the second facing portion 41C are alternately arranged.

As shown in FIG. 12, each of the comb teeth 33 has a first side surface 331 directed at least in the first orientation, a second side surface 333 directed at least in the second orientation and an end surface 335 directed at least in the third orientation. A shape of each of the comb teeth 33 is an inverted tapered shape when viewed along the up-down direction. In other words, a size of the comb tooth 33 in the front-rear direction is increased toward the end surface 335. Owing to this shape, the first side surface 331 is directed in the fourth orientation as well as the first orientation. Moreover, the second side surface 333 is directed in the fourth orientation as well as the second orientation.

As understood from FIG. 12, the first side surface 331 of the comb tooth 33 serves as both of a first part 371C and a part of a fourth part 377C. The second side surface 333 of the comb tooth 33 serves as both of a second part 373C and the remaining part of the fourth part 377C. The end surface 335 of the comb tooth 33 serves as a third part 375C.

As shown in FIG. 12, each of the comb teeth 43 is also formed in an inverted tapered shape. In detail, each of the comb teeth 43 has a first side surface 431 directed at least in the first orientation, a second side surface 433 directed at least in the second orientation and an end surface 435 directed at least in the fourth orientation. The first side surface 431 is directed in the third orientation as well as the first orientation. The second side surface 433 is directed in the third orientation as well as the second orientation.

As understood from FIG. 12, the first side surface 431 of the comb tooth 43 serves as both of a second facing part 473C and a part of a fourth facing part 477C. The second side surface 433 of the comb tooth 43 serves as both of a first facing part 471C and the remaining part of the fourth facing part 477C. The end surface 435 of the comb tooth 43 serves as an additional third facing part 493. Additionally, in the present embodiment, a third facing part 475C is formed by the fork portion 45.

Referring to FIG. 12, the description will be made about one of the comb teeth 33 of the first facing portion 31C, wherein the one of the comb teeth 33 is located rearward of the remaining one. The following description is almost true for the remaining one of the comb teeth 33. However, the remaining one of the comb teeth 33 of the first facing portion 31C faces a side surface of the additional facing secondary line 419C.

As shown in FIG. 12, the first side surface 331 of the comb tooth 33 faces the second side surface 433 of the comb tooth 43 located forward of the comb tooth 33. The first side surface 331 of the comb tooth 33 and the second side surface 433 of the comb tooth 43, which face each other, form a first variable portion 501C and form a part of a fourth variable portion 523C. In other words, the first side surface 331 of the comb tooth 33 and the second side surface 433 of the comb tooth 43, which face each other, have a function adjusting a variation of a capacitance caused by a relative movement between the first facing portion 31C and the second facing portion 41C in both of the first horizontal direction and the second horizontal direction. This is because each of the comb teeth 33 and the comb teeth 43 has the inverted tapered shape and because each of the first side surface 331 of the comb tooth 33 and the second side surface 433 of the comb tooth 43 inclines from each of the first horizontal direction and the second horizontal direction.

As shown in FIG. 12, the second side surface 333 of the comb tooth 33 faces the first side surface 431 of the comb tooth 43 located rearward of the comb tooth 33. The second side surface 333 of the comb tooth 33 and the first side surface 431 of the comb tooth 43, which face each other, form a second variable portion 503C and form the remaining part of the fourth variable portion 523C. In other words, the second side surface 333 of the comb tooth 33 and the first side surface 431 of the comb tooth 43, which face each other, have a function adjusting a variation of the capacitance caused by the relative movement between the first facing portion 31C and the second facing portion 41C in both of the first horizontal direction and the second horizontal direction. This is because each of the comb teeth 33 and the comb teeth 43 has the inverted tapered shape and because each of the first side surface 331 of the comb tooth 33 and the second side surface 433 of the comb tooth 43 inclines from each of the first horizontal direction and the second horizontal direction.

As shown in FIG. 12, the end surface 335 of the comb tooth 33 faces the fork portion 45 located between the two comb teeth 43. The end surface 335 of the comb tooth 33 and the fork portion 45, which face each other, form a third variable portion 521C.

As understood from FIG. 12, the first variable portion 501C and the second variable portion 503C serve as a first capacitance complementary adjusting portion 50C which adjusts a first variation of the capacitance of the upper facing portion 20C caused by a first movement of the second facing portion 41C relative to the first facing portion 31C in the first horizontal direction. The third variable portion 521C and the fourth variable portion 523C serve as a second capacitance complementary adjusting portion 52C which adjusts a second variation of the capacitance of the upper facing portion 20C caused by a second movement of the second facing portion 41C relative to the first facing portion 31C in the second horizontal direction.

As shown in FIG. 12, the end surface 435 of the comb tooth 43 and the fork portion 35 of the first facing portion 31C face each other in the second horizontal direction to form an additional third variable portion 59. The additional third variable portion 59 acts in the same way as the third variable portion 521C upon the second movement of the second facing portion 41C relative to the first facing portion 31C in the second horizontal direction and functions as a part of the second capacitance complementary adjusting portion 52C.

As mentioned above, also in the antenna 10C according to the present embodiment, the first capacitance complementary adjusting portion 50C and the second capacitance complementary adjusting portion 52C are provided. Accordingly, a variation of the capacitance of the upper facing portion 20C is suppressed even if a movement of the second facing portion 41C relative to the first facing portion 31C is caused. In addition, since the antenna 10C according to the present embodiment employs comb teeth shapes for the first facing portion 31C and the second facing portion 41C, it can reduce a difference between an effect on the capacitance according to a movement of the second facing portion 41C relative to the first facing portion 31C in the first orientation and an effect on the capacitance according to a movement of the second facing portion 41C relative to the first facing portion 31C in the second orientation. In addition, the antenna 10C can reduce a difference between an effect on the capacitance according to a movement of the second facing portion 41C relative to the first facing portion 31C in the third orientation and an effect on the capacitance according to a movement of the second facing portion 41C relative to the first facing portion 31C in the fourth orientation. In this manner, variations of characteristics of the antenna 10C caused by a relative movement between the first facing portion 31C and the second facing portion 41C can be further suppressed.

Fifth Embodiment

Figure 13:
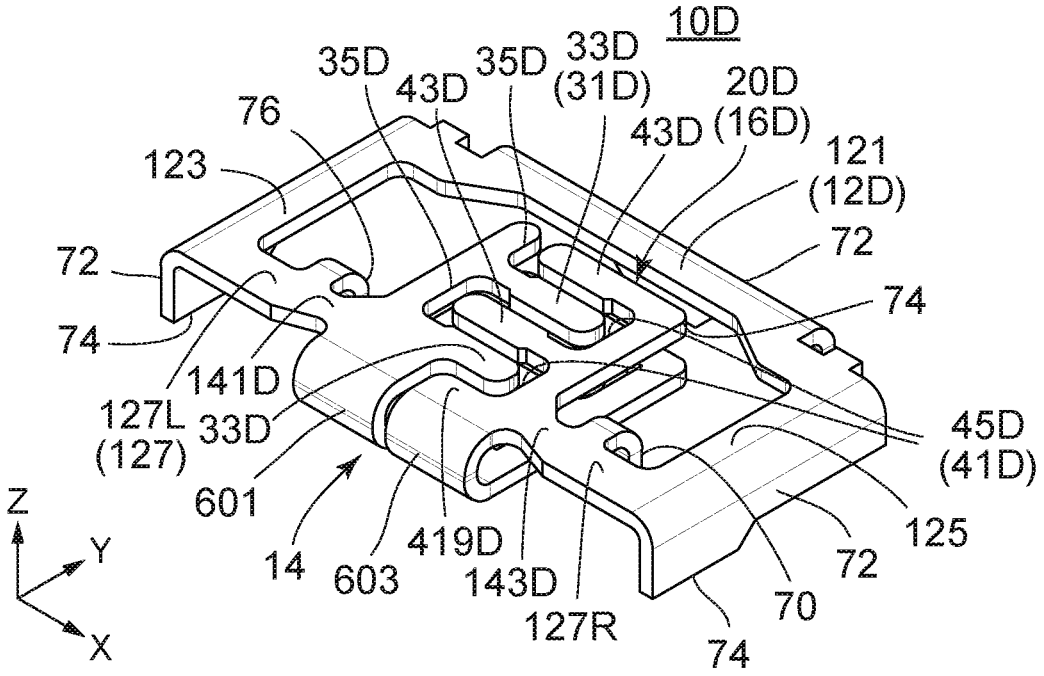
FIG. 13 is a top, perspective view showing an antenna according to a fifth embodiment of the present invention.
Figure 14:
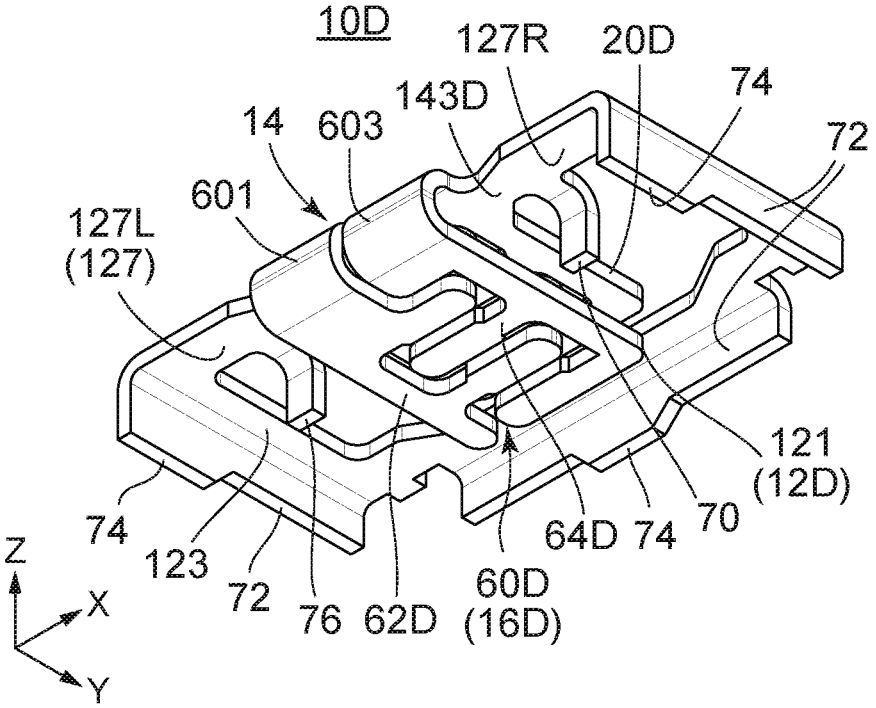
FIG. 14 is a bottom, perspective view showing the antenna of FIG. 13.

Referring to FIGS. 13 and 14, an antenna 10D according to a fifth embodiment of the present invention is similar to the antenna 10C according to the fourth embodiment shown in FIGS. 10 to 12. In detail, a facing portion 16D of the antenna 10D has an upper facing portion 20D and a lower facing portion 60D. The upper facing portion 20D has a first facing portion 31D and a second facing portion 41D while the lower facing portion 60D has a third facing portion 62D and a fourth facing portion 64D. When viewed along the up-down direction, the upper facing portion 20D and the lower facing portion 60D are identical with each other in shape. Comb teeth 33D of the antenna 10D and comb teeth 43D of the antenna 10D are different from the comb teeth 33C of the antenna 10C and the comb teeth 43C of the antenna 10C, respectively.

Figure 15:
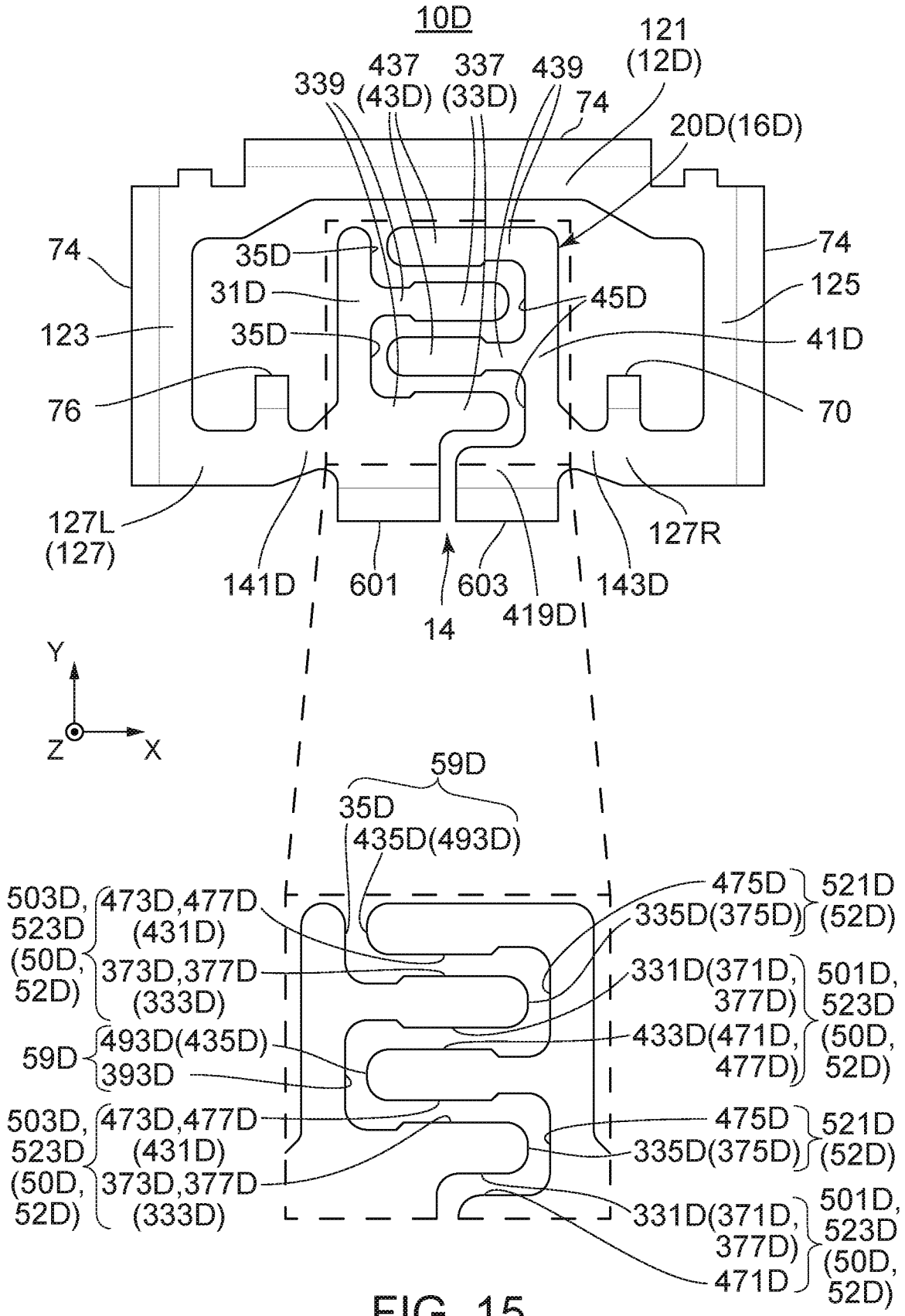
FIG. 15 is a plan view showing the antenna of FIG. 13. A facing portion is enlarged to be drawn.
Figure 16:
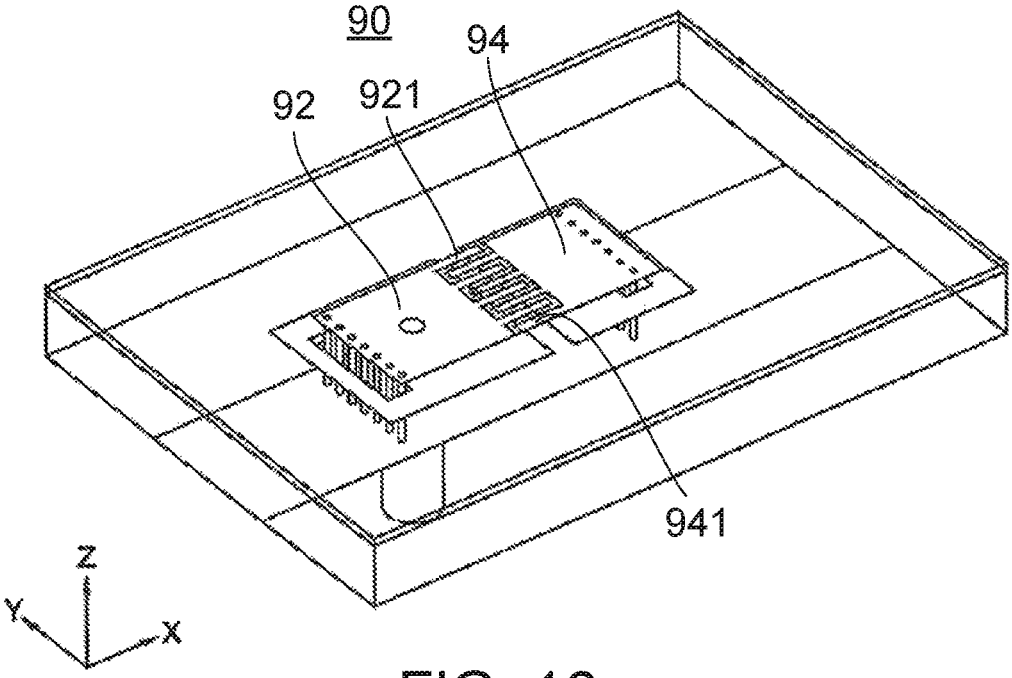
FIG. 16 PRIOR ART
FIG. 16 is a perspective view showing an antenna disclosed in Patent Document 1.

As shown in FIG. 15, each of the comb teeth 33D of the first facing portion 31D has a first side surface 331D directed at least in the first orientation, a second side surface 333D directed at least in the second orientation and an end surface 335D directed at least in the third orientation. Moreover, each of the comb teeth 33D has a wide portion 337 and a narrow portion 339 between the first side surface 331D and the second side surface 333D. The wide portion 337 is a part having a relatively large size in the first horizontal direction while the narrow portion 339 is a part having a relatively small size in the first horizontal direction. In the present embodiment, the wide portion 337 and the narrow portion 339 are contiguous to each other so that the narrow portion 339 is located at a basal part of the comb tooth 33D while the wide portion 337 is located at a distal part of the comb tooth 33D.

As understood from FIG. 15, the first side surface 331D of the comb tooth 33D serves as a first part 371D while the second side surface 333D of the comb tooth 33D serves as a second part 373D. Moreover, the end surface 335D of the comb tooth 33D serves as a third part 375D. In the present embodiment, a part of the first side surface 331D and a part of the second side surface 333D which correspond to the wide portion 337 serve also as a fourth part 377D.

As shown in FIG. 15, each of the comb teeth 43D of the second facing portion 41D is formed like the comb tooth 33D. In other words, each of the comb teeth 43D has a first side surface 431D directed at least in the first orientation, a second side surface 433D directed at least in the second orientation and an end surface 435D directed at least in the fourth orientation. Moreover, each of the comb teeth 43D has a wide portion 437 and a narrow portion 439 between the first side surface 431D and the second side surface 433D. The wide portion 437 is a part having a relatively large size in the first horizontal direction while the narrow portion 439 is a part having a relatively small size in the first horizontal direction. In the present embodiment, the wide portion 437 and the narrow portion 439 are contiguous to each other so that the narrow portion 439 is located at a basal part of the comb tooth 43D while the wide portion 437 is located at a distal part of the comb tooth 43D.

As understood from FIG. 15, the first side surface 431D of the comb tooth 43D serves as a second facing part 473D while the second side surface 433D of the comb tooth 43D serves as a first facing part 471D. The end surface 435D of the comb tooth 43D serves as an additional third facing part 493D. Additionally, in the present embodiment, a third facing part 475D is formed by a fork portion 45D. Moreover, in the present embodiment, a part of the first side surface 431D and a part of the second side surface 433D which correspond to the wide portion 437 serve also as the fourth facing part 477D.

Referring to FIG. 15, the description will be made about one of the comb teeth 33D of the first facing portion 31D, wherein the one of the comb teeth 33D is located rearward of the remaining one. The following description is almost true for the remaining one of the comb teeth 33D. However, the remaining one of the comb teeth 33D of the first facing portion 31D faces a side surface of a second end portion 143D.

As shown in FIG. 15, the first side surface 331D of the comb tooth 33D faces the second side surface 433D of the comb tooth 43D located forward of the comb tooth 33D. The first side surface 331D of the comb tooth 33D and the second side surface 433D of the comb tooth 43D, which face each other, form a first variable portion 501D.

As shown in FIG. 15, the second side surface 333D of the comb tooth 33D faces the first side surface 431D of the comb tooth 43D located rearward of the comb tooth 33D. The second side surface 333D of the comb tooth 33D and the first side surface 431D of the comb tooth 43D, which face each other, form a second variable portion 503D.

As shown in FIG. 15, the end surface 335D of the comb tooth 33D faces the fork portion 45D located between the two comb teeth 43D. The end surface 335D of the comb tooth 33D and the fork portion 45D, which face each other, form a third variable portion 521D.

As understood from FIG. 15, a wide portion 337D of the comb tooth 33D overlaps with wide portions 437D of the comb teeth 43D located forward and rearward of the comb tooth 33D in the second horizontal direction. A size of an overlapped part between the wide portion 337D of the comb tooth 33D and the wide portions 437D of the comb teeth 43D is varied by a movement of the second facing portion 41D relative to the first facing portion 31D in the second horizontal direction. In other words, the wide portion 337D of the comb tooth 33D and the wide portion 437D of the comb tooth 43D facing the wide portion 337D have an effect on a capacitance of the upper facing portion 20D according to the movement of the second facing portion 41D relative to the first facing portion 31D. This effect on the capacitance is opposite to an effect of the third variable portion 521D on the capacitance. Thus, the wide portion 337D of the comb tooth 33D and the wide portion 437D of the comb tooth 43D, which face each other, form a fourth variable portion 523D.

As understood from FIG. 15, the first variable portion 501D and the second variable portion 503D work as a first capacitance complementary adjusting portion 50D which adjusts a first variation of the capacitance of the upper facing portion 20D caused by a first movement of the second facing portion 41D relative to the first facing portion 31D in the first horizontal direction. The third variable portion 521D and the fourth variable portion 523D work as a second capacitance complementary adjusting portion 52D which adjust a second variation of the capacitance of the upper facing portion 20D caused by a second movement of the second facing portion 41D relative to the first facing portion 31D in the second horizontal direction.

As shown in FIG. 15, the end surface 435D of the comb tooth 43D and a fork portion 35D of the first facing portion 31D face each other in the second horizontal direction to form an additional third variable portion 59D. The additional third variable portion 59D acts in the same way as the third variable portion 521D upon the second movement of the second facing portion 41D relative to the first facing portion 31D in the second horizontal direction and functions as a part of the second capacitance complementary adjusting portion 52D.

As mentioned above, also in the antenna 10D according to the present embodiment, the first capacitance complementary adjusting portion 50D and the second capacitance complementary adjusting portion 52D are provided. Accordingly, a variation of the capacitance of the upper facing portion 20D is suppressed even if a movement of the second facing portion 41D relative to the first facing portion 31D is caused. In addition, since the comb teeth shapes are employed for the first facing portion 31D and the second facing portion 41D, a difference between an effect on the capacitance according to a movement of the second facing portion 41D relative to the first facing portion 31D in the first orientation and an effect on the capacitance according to a movement of the second facing portion 41D relative to the first facing portion 31D in the second orientation can be reduced. In addition, a difference between an effect on the capacitance according to a movement of the second facing portion 41D relative to the first facing portion 31D in the third orientation and an effect of a movement of the second facing portion 41D relative to the first facing portion 31D in the fourth orientation can be reduced. In this manner, variations of characteristics of the antenna 10D caused by a relative movement between the first facing portion 31D and the second facing portion 41D can be further suppressed.

Although the specific explanation about the present invention is made above referring to the embodiments, the present invention is not limited thereto but susceptible of various modifications and alternative forms without departing from the spirit of the invention. For example, each of the antennas 10, 10B, 10C and 10D of the first and the third to the fifth embodiments may not have the lower facing portion 60, 60B, 60C or 60D. Moreover, the antenna 10A of the second embodiment may have a lower facing portion formed to have the same structure as the facing portion 16A. Furthermore, in each of the facing portions 16, 16A, 16B, 16C and 16D, a size in the first horizontal direction and a size in the second horizontal direction may be set freely. In addition, although each of the antennas 10, 10A, 10B, 10C and 10D is a discrete part, the present invention is also applicable to an antenna formed on a substrate by printing. In that case, variations of characteristics of the antenna caused by a manufacturing variation such as miss printing can be suppressed.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An antenna comprising a main portion, a facing portion, a first feeding terminal and a second feeding terminal, wherein:

the main portion has a ring-shape with a split and has a first end portion and a second end portion which form the split;

the facing portion has a first facing portion provided to the first end portion and a second facing portion provided to the second end portion;

the first facing portion and the second facing portion are apart from each other and face each other in a horizontal plane defined by a first horizontal direction and a second horizontal direction perpendicular to the first horizontal direction;

the first facing portion and the second facing portion have a capacitance;

the first feeding terminal and the second feeding terminal are provided to the main portion;

the facing portion is provided with a first capacitance complementary adjusting portion and a second capacitance complementary adjusting portion;

the first capacitance complementary adjusting portion adjusts a first variation of the capacitance caused by a first movement of the second facing portion relative to the first facing portion in the first horizontal direction;

the second capacitance complementary adjusting portion adjusts a second variation of the capacitance caused by a second movement of the second facing portion relative to the first facing portion in the second horizontal direction;

the first capacitance complementary adjusting portion has a first variable portion and a second variable portion which have mutually opposite effects on the capacitance according to the first movement; and the second capacitance complementary adjusting portion has a third variable portion and a fourth variable portion which have mutually opposite effects on the capacitance according to the second movement.

2. The antenna as recited in claim 1, wherein:

the antenna is to be mounted on an object; and the first feeding terminal and the second feeding terminal are fixed parts which are fixed on the object when the antenna is mounted on the object.

3. The antenna as recited in claim 1, wherein:

the first horizontal direction gives a first orientation and a second orientation which are directed in mutually opposite directions;

the second horizontal direction gives a third orientation and a fourth orientation which are directed in mutually opposite directions;

the first facing portion has a first part directed at least in the first orientation, a second part directed at least in the second orientation, a third part directed at least in the third orientation and a fourth part directed at least in the fourth orientation;

the second facing portion has a first facing part directed at least in the second orientation, a second facing part directed at least in the first orientation, a third facing part directed at least in the fourth orientation and a fourth facing part directed at least in the third orientation;

the first part and the first facing part face each other to form the first variable portion;

the second part and the second facing part face each other to form the second variable portion;

the third part and the third facing part face each other to form the third variable portion; and the fourth part and the fourth facing part face each other to from the fourth variable portion.

4. The antenna as recited in claim 1, wherein:

one of the first facing portion and the second facing portion has a first primary line extending in the second horizontal direction and a second primary line extending from an end of the first primary line in the first horizontal direction;

a remaining one of the first facing portion and the second facing portion has a third primary line extending in the first horizontal direction, a fourth primary line extending from an end of the third primary line in the second horizontal direction and a fifth primary line extending from an end of the fourth primary line in the first horizontal direction;

the second primary line has an end portion facing the fourth primary line in the first horizontal direction;

the second primary line is located between the third primary line and the fifth primary line in the second horizontal direction;

the second primary line is provided with at least one of a secondary line extending toward the third primary line and a secondary line extending toward the fifth primary line;

at least one of the third primary line and the fifth primary line is provided with a facing secondary line extending toward the second primary line in the second horizontal direction and faces the secondary line in the first horizontal direction; and the secondary line is located between the fourth primary line and the facing secondary line in the first horizontal direction.

5. The antenna as recited in claim 1, wherein:

each of the first facing portion and the second facing portion has a plurality of comb teeth and a plurality of fork portions and has a comb-shape;

each of the comb teeth has a first side surface, a second side surface and an end portion and has an inverted tapered shape;

the comb teeth of the first facing portion and the comb teeth of the second facing portion are alternately arranged in the first horizontal direction;

the first variable portion consists of the first side surfaces of the comb teeth of the first facing portion and the second side surfaces of the comb teeth of the second facing portion which face the first side surfaces of the comb teeth of the first facing portion, respectively;

the second variable portion consists of the second side surfaces of the comb teeth of the first facing portion and the first side surfaces of the comb teeth of the second facing portion which face the second side surfaces of the comb teeth of the first facing portion, respectively;

the third variable portion consists of the end portions of the comb teeth and the fork portions facing the end portions, respectively; and the fourth variable portion consists of the first side surfaces of the comb teeth of the first facing portion and the second side surfaces of the comb teeth of the second facing portion which face the first side surfaces of the comb teeth of the first facing portion, respectively, and consists of the second side surfaces of the comb teeth of the first facing portion and the first side surfaces of the comb teeth of the second facing portion which face the second side surfaces of the comb teeth of the first facing portion, respectively.

6. The antenna as recited in claim 1, wherein:

each of the first facing portion and the second facing portion has a plurality of comb teeth and a plurality of fork portions and has a comb-shape;

each of the comb teeth has a first side surface, a second side surface and an end portion and has a wide portion and a narrow portion between the first side surface and the second side surface;

the comb teeth of the first facing portion and the comb teeth of the second facing portion are alternately arranged in the first horizontal direction;

the first variable portion consists of the first side surfaces of the comb teeth of the first facing portion and the second side surfaces of the comb teeth of the second facing portion which face the first side surfaces of the comb teeth of the first facing portion, respectively;

the second variable portion consists of the second side surfaces of the comb teeth of the first facing portion and the first side surfaces of the comb teeth of the second facing portion which face the second side surfaces of the comb teeth of the first facing portion, respectively;

the third variable portion consists of the end portions of the comb teeth and the fork portions facing the end portions, respectively; and the fourth variable portion consists of the wide portions of the first facing portion and the wide portions of the second facing portion which face the wide portions of the first facing portion, respectively.

* * * * *